US012478127B1

(12) United States Patent
Kirby

(10) Patent No.: US 12,478,127 B1
(45) Date of Patent: Nov. 25, 2025

(54) CATCHER'S SHOE

(71) Applicant: Matthew Kirby, Wilmington, DE (US)

(72) Inventor: Matthew Kirby, Wilmington, DE (US)

( * ) Notice: Subject to any disclaimer, the term of this patent is extended or adjusted under 35 U.S.C. 154(b) by 397 days.

(21) Appl. No.: 17/812,167

(22) Filed: Jul. 12, 2022

Related U.S. Application Data

(63) Continuation-in-part of application No. 16/860,039, filed on Apr. 27, 2020, now abandoned.

(60) Provisional application No. 62/839,069, filed on Apr. 26, 2019.

(51) Int. Cl.

| | |
|---|---|
| ***A43B 5/00*** | (2022.01) |
| ***A43B 5/18*** | (2006.01) |
| ***A43B 7/38*** | (2006.01) |
| ***A43B 13/14*** | (2006.01) |

(52) U.S. Cl.
CPC ..... *A43B 5/185* (2013.01); *A43B 5/00* (2013.01); *A43B 7/38* (2013.01); *A43B 13/148* (2013.01)

(58) Field of Classification Search
CPC .. A43B 5/00; A43B 7/144; A43B 7/16; A43B 7/38; A43B 13/148; A43B 13/37; A43B 23/081
See application file for complete search history.

(56) References Cited

U.S. PATENT DOCUMENTS

| | | | | |
|---|---|---|---|---|
| 2,198,338 | A * | 4/1940 | Greider | A43B 13/12 36/28 |
| 4,259,792 | A * | 4/1981 | Halberstadt | A43B 13/143 36/129 |
| 4,354,318 | A * | 10/1982 | Frederick | A43B 5/06 36/30 R |
| 4,949,476 | A * | 8/1990 | Anderie | A43B 5/06 36/114 |
| 8,336,230 | B2 * | 12/2012 | Crowley | A43B 5/00 36/105 |
| 9,032,644 | B1 * | 5/2015 | Koo | A43B 13/125 36/11.5 |
| 9,974,353 | B2 * | 5/2018 | Mulholland | A43B 13/26 |
| 10,292,452 | B2 * | 5/2019 | Hansen | B32B 3/263 |
| 10,349,701 | B2 * | 7/2019 | Baltierra | A43B 13/40 |
| 10,966,482 | B2 * | 4/2021 | Aubonnet | A43B 13/188 |
| 2010/0095556 | A1 * | 4/2010 | Jarvis | A43B 3/0047 36/43 |
| 2020/0113272 | A1 * | 4/2020 | Aubonnet | A43B 13/183 |
| 2021/0315320 | A1 * | 10/2021 | Takamasu | A43B 13/187 |

* cited by examiner

*Primary Examiner* — Sharon M Prange
(74) *Attorney, Agent, or Firm* — RAMBERG IP, LLC

(57) ABSTRACT

A shoe configured for athletic activity features a sole including a heel portion, an interior floor portion, a toe portion, a rear portion, a top, and left and right sides, all assembled to define a closed-end cavity sized for ingress and egress of a human foot, and further including means for releasably clamping the shoe against the foot, wherein a top surface of said interior floor portion at the rear of the shoe has an elevation that is 1.5 to 3.375 inches greater than a top surface of said interior floor portion at the front (toe region) of the shoe. The heel portion of said sole may be wider laterally than other portions of the sole.

17 Claims, 4 Drawing Sheets

CATCHER'S SHOE

CROSS-REFERENCE TO RELATED APPLICATION(S)

This patent document is a Continuation-in-Part of U.S. patent application Ser. No. 16/860,039, filed on Apr. 27, 2020, which claims the benefit of U.S. Provisional Patent Application No. 62/839,069, filed on Apr. 26, 2019, both in the name of Matthew Kirby and both of whose contents are incorporated by reference herein in their entirety.

STATEMENT OF FEDERALLY SPONSORED RESEARCH

None.

BACKGROUND OF THE INVENTION

1. Field of the Invention

The present invention relates to shoes, and particularly to athletic shoes, and even more particularly to the shoes worn by baseball catchers.

2. Discussion of Related Art

The position of "catcher" on a baseball team is a physically difficult one. There are numerous risks of injury, from being hit by the pitched baseball, to foul tips, to runners sliding into home plate. In addition, the catcher is expected to assume a crouching position on the front of the feet, with the knees off of the ground. Maintaining such a position is painful and fatiguing, and not just of the back of the legs, but extending also to the knees, ankles and back. The pain and fatigue can be the cause of premature retirement from the game. On top of being fatiguing, the catcher is expected to jump up to throw the ball to a base to try to get a runner out, and to chase after a foul pop-up.

Swiss Patent No. CH664474 discloses a shoe, particularly suitable for soccer play, featuring the sole of the shoe being raised in the rear to facilitate and speed up shot-making, cleats that are fixed to the sole in such a way to avoid removal of soil when they detach from it, the tip of the sole being made of a material that favors adherence to the ball, and the front of the sole being knurled to increase grip on the ground.

SUMMARY OF THE INVENTION

These and other problems with the known art are addressed and solved by providing a shoe having a "forward tilt"; that is, the top surface of an interior floor of the shoe has a greater elevation at the heel or rearward portion of the shoe than the top surface of this interior floor portion at the front or toe portion of the shoe. heel of expanded height. This forward tilt permits the catcher to maintain his former crouch position, but with the full sole of the shoe on the ground; that is, the heel portion is also in contact with the ground. If the forward tilt is due to the heel of the shoe being of extended or expanded height, such heel optionally may be detachable from the rest of the shoe so that the catcher does not have to change shoes to bat or run. The heel portion of the shoe may also have an expanded width ("flared"). Except as otherwise noted herein, the shoe of the present invention may be fabricated from leather or artificial leather.

DETAILED DESCRIPTION OF EMBODIMENTS OF THE INVENTION

Figure 1:
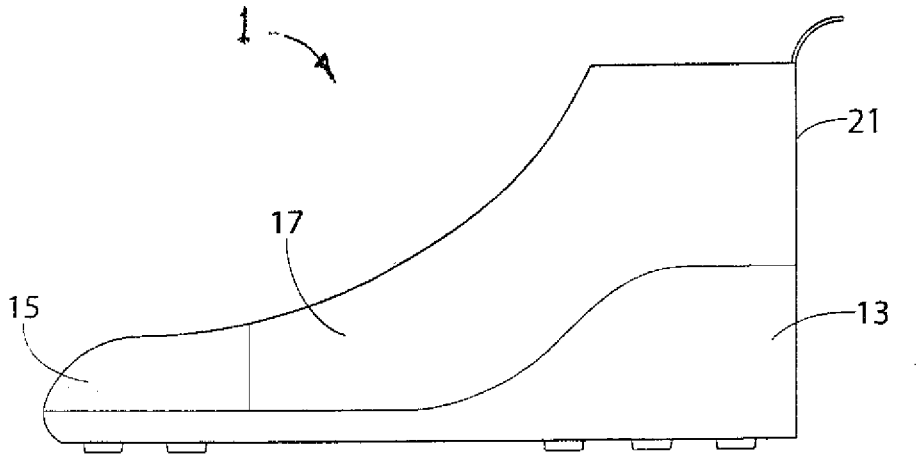
FIGS. 1, 3 and 5 are side views of various embodiments of the shoe of the present invention, showing various features.
Figure 2:
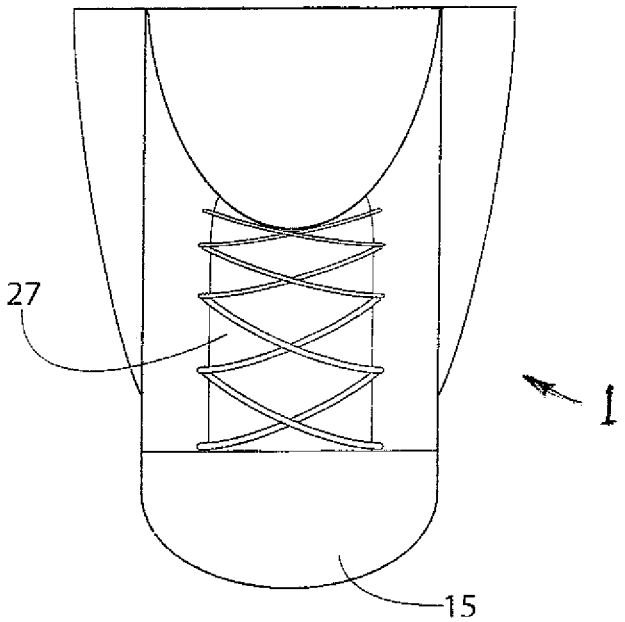
FIGS. 2, 4 and 6 are top views of various embodiments of the inventive shoe, showing various features.
Figure 3:
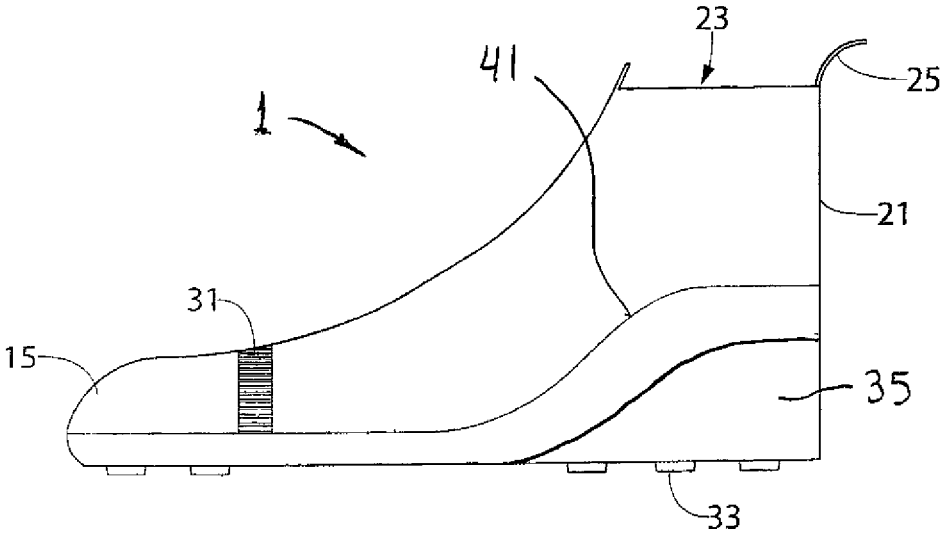
Figure 4:
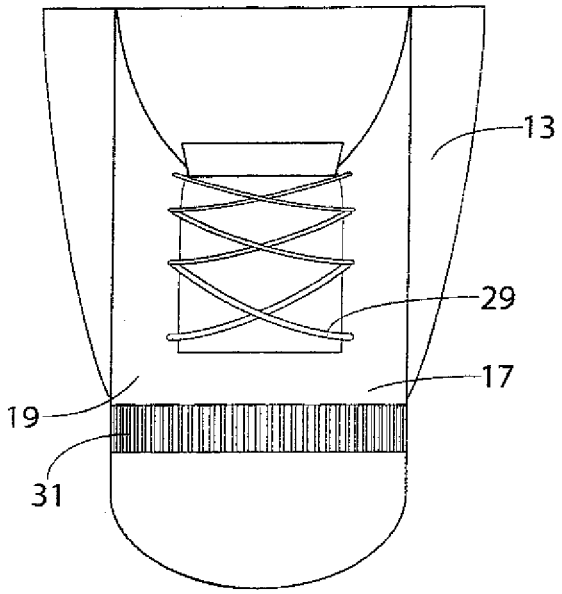

A shoe configured for athletic activity features a sole including a heel portion, an interior floor portion, a toe portion, a rear portion, a top, and left and right sides, all assembled to define a closed-end cavity sized for ingress and egress of a human foot, and further including means for releasably clamping the shoe against the foot, wherein a top surface of said interior floor portion at the rear of the shoe has an elevation that is 1.5 to 3.375 inches greater than a top surface of said interior floor portion at the front (toe region) of the shoe. The heel portion of said sole may be wider laterally than other portions of the sole.

In a first aspect of the present invention, the shoe features: a sole of varying height or thickness, a toe portion, a rear portion, a top, and left and right sides, all assembled together, for example, via gluing or stitching, to define a closed-end cavity sized for ingress and egress of a human foot. The shoe features a means for releasably clamping the shoe against the foot, such as laces or VELCRO hook-and-loop fastening system straps. The heel portion of the shoe, which may be separate from, or integrated with, the sole of the shoe, has a height or thickness of two to three inches, and a portion of the sole corresponding to a toe region of the shoe has a height or thickness that is no more than about one-half inch. An exemplary range for this toe region of the sole might be one-sixteenth to three-eighths of an inch thick. In addition, a portion of the sole corresponding to a region of the shoe other than the heel and toe has a height or thickness somewhere in between these two limits or ranges. In other words, the portion of the shoe that is most elevated is the rear portion of the shoe, directly above the heel. In the embodiment in which the heel is integrated with the sole, the transition in thickness of the sole from the front to the rear may be smooth or abrupt, e.g., discontinuous.

In a second aspect of the present invention, the shoe does not necessarily require a sole of varying thickness, e.g., an elevated heel, to achieve the goal of the wearer's heel being elevated relative to his or her toe when wearing the instant shoe. The difference or change in elevation could be caused by a sole that is thicker or greater in height at the rear than at the front of the shoe. But it could also be caused, or be the result of an insole or insert that has this property, or is selectively placed toward the rear (heel portion) of the shoe. However it is accomplished, the end result is that an interior floor of the shoe, that is, the part of the shoe that is in contact with the sole of the wearer's foot, is effectively "tilted forward" such that the top surface of this interior floor portion at the rear, or heel portion, of the shoe is at a significantly greater elevation than the top surface of this interior floor portion at the front, or toe portion, of the shoe. In both aspects, the shoe is designed for athletic activity.

Referring now to FIGS. 1-9, embodiments of the invention will now be described in greater detail. Like numbers in the figures refer to like components. The figures are not to scale.

Shoe 1 includes a sole 11 supporting toe 15, left side 17, right side 19 and rear 21. Hinge 31 defines a boundary between toe 15 and left 17 and right 19 sides, and attached to each. Top or tongue 27 attaches to toe or hinge and provides an upper cover over the foot. Opening 23 permits entry and egress of the foot, permitting the wearer to put on and take off the shoe. Bootstrap 25 assists the wearer in pulling the rear of the shoe over the heel of the foot.

Particular attention is directed toward heel 13 of the shoe. In the embodiments depicted, heel 13 is part (integrated) of sole 11, but in other embodiments, it could be a separate piece. The heel is thick so as to elevate the rear of the shoe 2 to 3 inches off of the ground. The heel also covers a large area (has a large "footprint") to support the weight of the wearer, so that the heel does not sink into the ground under the pressure applied against the ground by the weight of a baseball catcher. The heel is at least 2 inches in length, front-to-back, and may be 3 or 4 inches. The heel is also as wide as the shoe is wide, at least 2 inches, and preferably more like 3 inches. In one embodiment, the heel may also feature an additional width beyond the width of the rest of the shoe, and may further feature a taper or flare in this enhanced width, gradually increasing from front to back. In the embodiment shown in FIG. 8, the flared heel also is tapered vertically, gradually increasing in width from the top down to the bottom of the heel. The flared heel may have a width at its widest point of 4 to 5 inches.

The shoe of the present invention features the wearer's foot being elevated 2 to 3.5 inches off of the ground at the heel portion of the foot. Up to this point, this has been accomplished with a shoe sole that increases in thickness from front to back. But such is not required. For example, the heel of the shoe could be a separate piece from the shoe sole. Further, the instant shoe could feature inserts or insoles that vary in thickness, or are applied (inserted) only toward the rear portion of the inside of the shoe.

The shoe of the present invention features a "forward tilt". Some athletic shoes such as running shoes may sometimes also feature a forward tilt, but the shoe of the present invention is in a different category altogether, as its tilt is significantly greater. This is because the shoe of the present invention is for an entirely different purpose than other athletic shoes—to relieve stress on the back of the leg when the wearer is in a crouching position.

Figure 5:
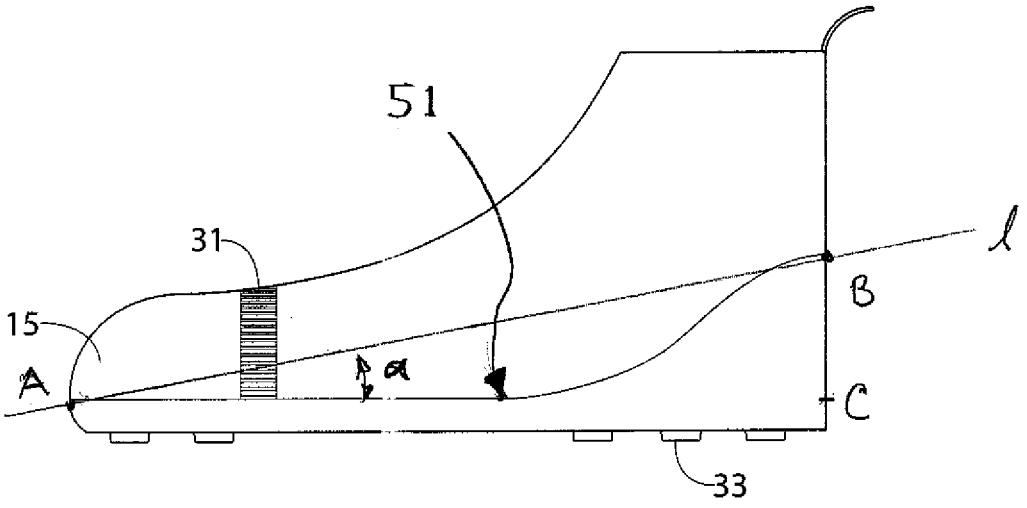
Figure 6:
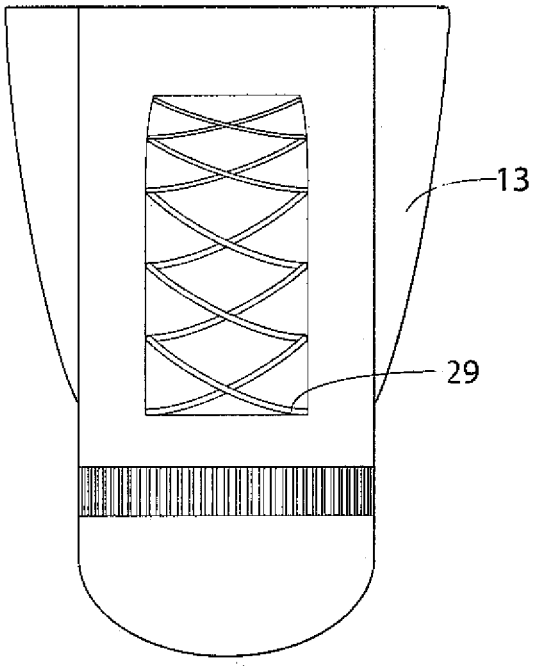
Figure 7:
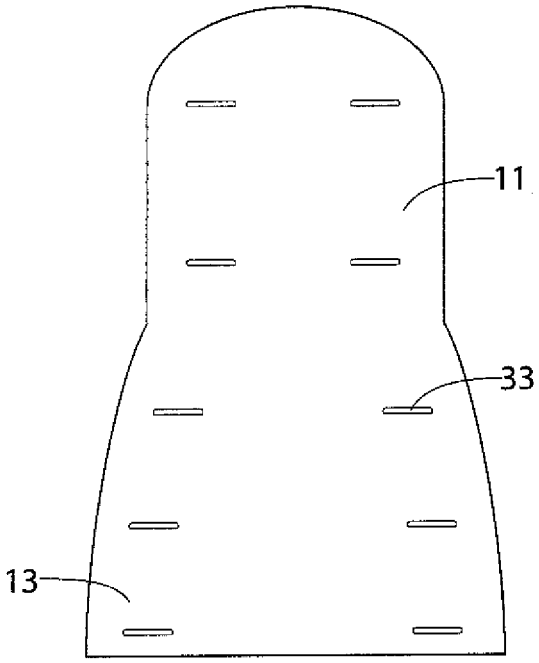
FIG. 7 is a bottom view of one embodiment of the present inventive shoe.
Figure 8:
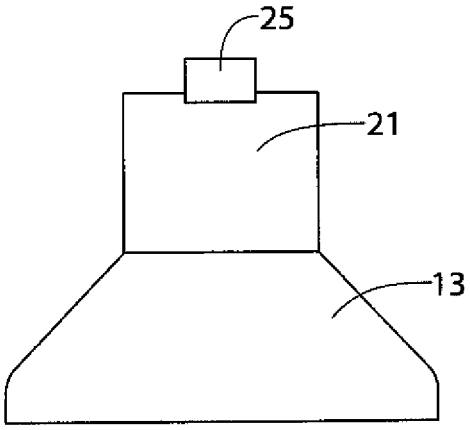
FIG. 8 is a rear view of one embodiment of the present inventive shoe.
Figure 9:
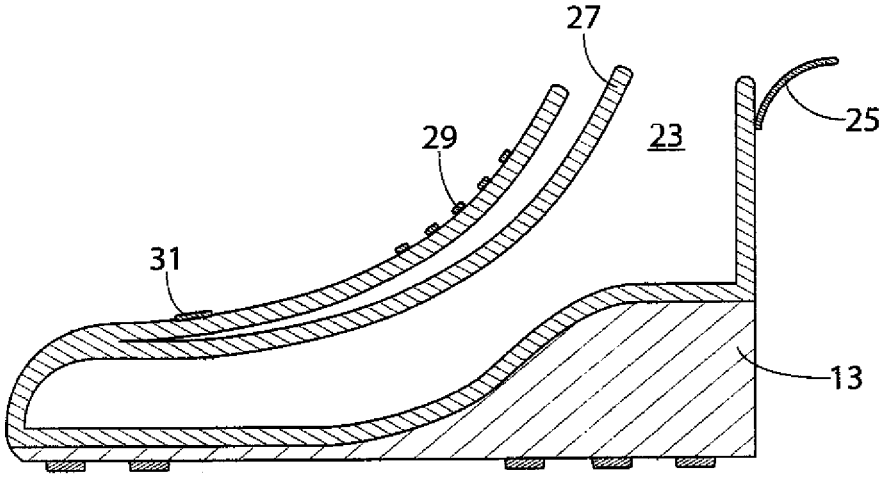
FIG. 9 is a cross-sectional side view of one embodiment of the present inventive shoe.

The degree or amount of this forward tilt may be expressed with reference to FIG. 5. Points "A" and "B" are at the most forward point and most rearward point, respectively, of the top surface 51 of interior floor portion 41, thereby forming the bottom of closed-end cavity 23. Point "C" is at the rear of the heel of the shoe and is at the same elevation above the bottom of the sole as point "A". Thus, line segment AC represents the approximate overall length of the shoe, and is a horizontal line extending from point "A". Line "I" passing through points A and B makes an angle alpha ($\alpha$) with respect to line segment AC. Here, the elevation of surface 51 with respect to line segment AC increases monotonically, but not uniformly, from point A to point B. In other embodiments of the invention, however, the change in elevation could be uniform.

There are thus at least two ways to express the change in elevation of surface 51. The first way is simply in absolute terms. Point A may range between ⅛ inch and ½ inch in elevation from the bottom surface of sole 11. Point B may range from 2 inches to 3.5 inches from this bottom surface. Thus, the difference in elevation between points A and B may vary between 1½ inches and 3⅜ inches. Thus, exemplary elevation differences such as 2, 2.5 and 3 inches are contemplated.

Another way to express the change in elevation of surface 51 is by means of angle "alpha". Line segment BC is essentially the change in elevation caused by raising the rear portion of the shoe. Line segment AC effectively is the length of the shoe. From trigonometry, the tangent of angle "alpha" is the length of segment BC divided by the length of segment AC. Inverting, the angle "alpha", then, is the arc tangent of BC divided by AC:

$$\alpha = \text{arc tan}(BC/AC)$$

The largest angle occurs when BC is greatest and AC is smallest. The shoe with the smallest reasonable length would be about 6 inches. It was stated previously that the largest change in elevation is about 3.375 inches. Thus, $\alpha$=arc tan (3.375/6)=arc tan 0.5625, or approximately 30 degrees.

Similarly, the smallest angle occurs when BC is least and AC is greatest. The shoe with the longest reasonable length would be about 10 inches. It was stated previously that the smallest change in elevation is about 1.5 inches. Thus, $\alpha$=arc tan (1.5/10)=arc tan 0.150, or approximately 8.5 degrees. Again, exemplary angles of forward tilt such as 10, 15, 20 and 25 degrees are also contemplated.

The instant shoe contains provisions for laces or straps 29 for securing the shoe to the wearer's foot once the wearer has placed his foot completely in the shoe.

In one embodiment, the shoe may feature cleats 33 on the sole to enhance traction against a grassy or dirt surface. The cleats may be made of metal or rubber.

In another embodiment, the shoe does not contain cleats, but instead features a "turf bottom", which is a sole made of rubber or similar elastomer that also has high friction against most surfaces, for good traction. The turf bottom sole is useful for taking the shoes indoors without having to remove them first to prevent damage to floors or carpeting.

The toe 15 may be reinforced, for example with leather or other shoe materials to help reduce premature wear. To help the present shoe flex better between the toe portion and the rest of the shoe, a hinge 31 may be provided in the shoe between the toe portion and the rest of the shoe. The hinge may extend across the top and around the sides, and may terminate at the sole of the shoe. The hinge permits the toe portion to flex or bend upward somewhat relative to the rest of the shoe. This region or boundary between the toe portion and the rest of the shoe is subject to high wear or premature wear, due to the flexing at this junction. The hinge helps to reduce this wear; thus, it serves a reinforcing function. The hinge may be fabricated from leather, real or artificial, mesh, and/or certain polymers, e.g., rubber. The hinge itself may be reinforced, for example, with leather, real or artificial.

In another embodiment, the toe 15 may be reinforced, for example with metal or hard plastic, to protect the catcher's toes from impact by bats or thrown baseballs. To the extent that this kind of reinforcement makes the front of the shoe rigid, the hinge should help permit the toe portion still to flex with respect to the rest of the shoe.

The heel may be made removable 35 by providing a securement mechanism. In one embodiment, the mechanism could be a "bayonet lock" in which a quarter (90 degree) turn to the left or right locks or unlocks the heel from the rest of the shoe. Here, the heel 13 would be a component separate from the sole 11.

The way that the present shoe is used (worn) is virtually identical to existing shoes. The laces or straps (e.g., VELCRO hook-and-loop fastening system straps) are loosened to permit the wearer to insert his foot into the shoe, the foot is so inserted fully, and then the laces or straps are knotted or otherwise tightened to secure the foot inside the shoe.

Shoes having tall or extended heels are known, of course, but the shoe of the present invention differs in some important respects. For example, a type of woman's shoe known as a "high heel" would not work in the present context because such heels typically have a contact area that is less than one square inch. This small contact area would translate into a large compressive stress, and a surface like dirt or grass would not be able to support such a stress. The result would be that the heel would sink into the dirt or grass. Another known shoe with a tall heel is the "platform shoe". The purpose of such a shoe is to give the wearer the appearance of greater height. With this shoe, not only is the heel tall, but the entire sole is tall, and of approximate uniform height. This is not what is desired in a catcher's shoe, as it would not solve the problem of balance, and of pain in the limbs due to crouching.

INDUSTRIAL APPLICABILITY

The present inventive shoe provides help and advantages to baseball catchers by enabling them to assume a crouching position with the heels of their shoes on the ground, and yet maintain the usual "bending forward" position without having their knees touching the ground. This position will take some load off of the muscles in the rear of the legs, reducing muscle stress, and yet permit the catcher to rise up to a standing position quickly, for example, to defend home plate or to throw to a base. More broadly, it will reduce pain and discomfort of any part of the body affected by having to crouch for extended periods of time. It will also give greater balance to the catcher. In one embodiment, the elevated heel is removable so that the catcher can take a turn at bat or running the bases without having to change shoes. The hinge feature making the shoe more durable also may be particularly useful to apply or use in existing baseball catchers' shoes, or even in other kinds of athletic shoes.

In those embodiments in which the elevation of the rear portion of the shoe is accomplished primarily by a heel, those embodiments in which the heel is removable can make the shoe conducive to running, as alluded to above. In the absence of such removable elevated heel 35, the shoe is not configured for, or conducive to, running. In other words, in the absence of a removable elevated heel, the instant shoe is not a running shoe.

The present shoe could also have utility in any activity where crouching and mobility are needed, and not necessarily limited to athletics. For example, certain occupations such as plumbers and masons, involve a lot of such crouching.

The term "baseball" is meant to include other related or similar sports such as softball.

An artisan of ordinary skill will appreciate that various modifications may be made to the invention herein described without departing from the scope or spirit of the invention as defined in the appended claims.

What is claimed is:

1. A shoe, comprising:

(a) a sole including a heel portion, an interior floor portion, a toe portion reinforced with metal or hard plastic, a rear portion, a top, and left and right sides, all assembled to define a closed-end cavity sized for ingress and egress of a human foot, (b) and further comprising means for releasably clamping said shoe against the foot, (c) wherein said interior floor portion features a forward tilt such that a top surface of said interior floor portion at the rear portion of the shoe has an elevation that is at least 1.5 inches greater than a top surface of said interior floor portion at the toe portion of the shoe, (d) wherein an amount of said forward tilt is expressed as an angle that a straight line connecting said most forward point and most rearward point on said top surface of said interior floor portion makes with respect to a horizontal line running through said most forward point, said angle ranging from 15 degrees to 30 degrees, said angle being viewed as a side, cross-sectional view of said shoe;

(e) and still further wherein said heel portion of said sole is at least 4 inches in width and is also wider laterally than a lateral width of any other portion of said shoe, and (f) said shoe thereby being configured for a baseball catcher.

2. The shoe of claim 1, wherein said sole is configured for good traction on a dirt surface.

3. The shoe of claim 1, wherein said means for releasably clamping comprises at least one of laces and hook-and-loop fastening system straps.

4. The shoe of claim 1, wherein said heel portion is removably attached to said sole, and further wherein said angle ranging from 15 to 30 degrees only pertains to a state in which said heel is attached to said sole.

5. The shoe of claim 1, wherein said elevation is at least 2.5 inches greater than said top surface of said interior floor portion.

6. The shoe of claim 5, further comprising a hinged portion between the toe portion and a remainder or rest of said shoe.

7. The shoe of claim 6, wherein said hinged portion is reinforced.

8. The shoe of claim 1, wherein said heel portion includes a lateral width of 5 inches.

9. The shoe of claim 1, wherein said heel portion is at least 2 inches in length front to back.

10. A shoe, comprising:

(a) a sole, a toe portion, a rear portion, a heel, a top, left and right sides, an interior floor portion, and a hinged portion between said toe portion and top of said shoe, all assembled to define a closed-end cavity sized for ingress and egress of a human foot;

(b) further including means for releasably clamping said shoe against the foot;

(c) wherein said interior floor portion features a forward tilt such that a top surface of said interior floor portion at the most rearward point of said interior floor portion has a greater elevation than a top surface of said interior floor portion at the most forward point of said interior floor portion;

(d) wherein an amount of said forward tilt is expressed as an angle that a straight line connecting said most forward point and most rearward point on said top surface of said interior floor portion makes with respect to a horizontal line running through said most forward point, said angle ranging from 15 degrees to 30 degrees, said angle being viewed as a side, cross-sectional view of said shoe; and (e) wherein said heel of said sole includes a lateral width of at least 4 inches, and said lateral width is greater than a lateral width of any other portion of said shoe; and (f) said shoe thereby enhancing comfort of a wearer of said shoe assuming a crouching position with knees off of the ground.

11. The shoe of claim 10, wherein at least one of said sole and said heel is fabricated from an elastomer.

12. The shoe of claim 10, wherein said heel portion is removable, and further wherein said angle ranging from 15 to 30 degrees only applies to a state in which said heel is attached to said sole.

13. The shoe of claim 10, wherein said heel portion is tapered longitudinally from front to back.

14. The shoe of claim 13, wherein said tapered heel portion is also tapered vertically.

15. The shoe of claim 10, wherein said elevation is at least 2.5 inches greater than said top surface of said interior floor portion.

16. The shoe of claim 15, wherein at least one of said toe, left side, right side, rear portion, top and hinged portion is fabricated from leather or synthetic leather.

17. The shoe of claim 10, wherein said heel portion includes a lateral width of 5 inches.

* * * * *